US009038922B1

(12) United States Patent
McLeod

(10) Patent No.: US 9,038,922 B1
(45) Date of Patent: May 26, 2015

(54) SPRAY CONTAINMENT DEVICE AND METHODS OF USE

(76) Inventor: Frederick C. McLeod, Pataskala, OH (US)

( * ) Notice: Subject to any disclaimer, the term of this patent is extended or adjusted under 35 U.S.C. 154(b) by 21 days.

(21) Appl. No.: 12/833,213

(22) Filed: Jul. 9, 2010

Related U.S. Application Data

(60) Provisional application No. 61/271,847, filed on Jul. 27, 2009.

(51) Int. Cl.

| | |
|---|---|
| ***B05B 17/04*** | (2006.01) |
| ***B05B 1/28*** | (2006.01) |
| ***B05B 15/04*** | (2006.01) |
| ***B05B 1/00*** | (2006.01) |
| ***B05B 1/26*** | (2006.01) |

(52) U.S. Cl.
CPC ..... *B05B 1/265* (2013.01); *B05B 15/0443* (2013.01)

(58) Field of Classification Search
CPC ..... B05B 1/265; B05B 15/0443; A62C 31/02
USPC ..... 239/11, 288, 104, 288.3, 288.5, 600; 222/401, 175; 470/2, 8, 9, 11, 12; 16/404; 411/383, 385, 433, 539
See application file for complete search history.

(56) References Cited

U.S. PATENT DOCUMENTS

| | | | | | |
|---|---|---|---|---|---|
| 625,448 | A | * | 5/1899 | Jaenichen | 138/99 |
| 630,428 | A | * | 8/1899 | Wahlert | 126/317 |
| 2,044,687 | A | * | 6/1936 | Hatten | 169/50 |
| 2,566,324 | A | * | 9/1951 | Frese | 239/500 |
| 2,928,610 | A | * | 3/1960 | Fenimore | 239/288.5 |
| 2,985,383 | A | * | 5/1961 | Rasmusson et al. | 239/288.5 |
| 3,313,353 | A | * | 4/1967 | Williamson et al. | 169/47 |
| 3,318,535 | A | * | 5/1967 | New | 239/310 |
| 3,456,547 | A | * | 7/1969 | Strong | 411/105 |
| 3,672,380 | A | * | 6/1972 | Schuster | 134/172 |
| 3,770,204 | A | * | 11/1973 | Schuster | 239/288.5 |
| 3,850,373 | A | * | 11/1974 | Grolitsch | 239/499 |
| 3,936,000 | A | | 2/1976 | Weyn | |
| 4,044,953 | A | * | 8/1977 | Vogel | 239/229 |
| 4,199,896 | A | * | 4/1980 | Lehman | 47/1.7 |
| 4,478,546 | A | * | 10/1984 | Mercer | 411/385 |
| 4,863,198 | A | * | 9/1989 | Petranto | 285/39 |
| 4,865,257 | A | * | 9/1989 | Bailey | 239/288.5 |
| 4,886,122 | A | * | 12/1989 | Goodnight | 169/74 |
| 4,975,014 | A | * | 12/1990 | Rufin et al. | 411/385 |
| 5,090,857 | A | * | 2/1992 | Dunn | 411/385 |
| 5,170,943 | A | * | 12/1992 | Artzberger | 239/532 |
| 5,226,678 | A | * | 7/1993 | Petranto | 285/39 |
| 5,419,077 | A | * | 5/1995 | Tombarelli | 43/132.1 |
| 5,634,754 | A | * | 6/1997 | Weddendorf | 411/354 |
| 5,636,795 | A | | 6/1997 | Sedgwick | |
| 5,794,855 | A | | 8/1998 | Ledford | |
| 6,113,008 | A | | 9/2000 | Arsenault et al. | |
| 6,163,895 | A | * | 12/2000 | Davenport | 4/255.06 |

(Continued)

*Primary Examiner* — Jason Boeckmann
*Assistant Examiner* — Steven M Cernoch

(57) ABSTRACT

A spray containment device comprising: a threaded adapter, a conical body having a threaded aperture wherein the threaded aperture is adapted to cooperate with said threaded adapter, and (c) at least one threaded nut adapted to thread onto the threaded adapter above the conical body so as to secure the conical body to the threaded adapter. Also included is a sprayer device comprising a liquid container and a spray wand to which the spray containment device may be attached. The threaded adapter and nut system could be utilized to attach threads to other types of pipes, rods or similarly shaped pieces.

7 Claims, 11 Drawing Sheets

(56) References Cited

U.S. PATENT DOCUMENTS

| | | | | |
|---|---|---|---|---|
| 6,205,702 | B1 * | 3/2001 | Ammons | 43/132.1 |
| 6,250,338 | B1 * | 6/2001 | Dempsey | 138/103 |
| 6,527,058 | B1 * | 3/2003 | Nerat | 169/30 |
| 6,612,936 | B1 * | 9/2003 | Matias | 473/256 |
| 6,663,307 | B2 | 12/2003 | Kopanic et al. | |
| 6,679,438 | B1 | 1/2004 | Didlo | |
| D502,759 | S | 3/2005 | Smoot | |
| 6,948,637 | B1 | 9/2005 | Jacobs | |
| 7,040,510 | B1 | 5/2006 | Hester | |
| 7,063,275 | B2 | 6/2006 | Byron | |
| 7,076,916 | B2 | 7/2006 | Bianchini | |
| 7,431,222 | B2 | 10/2008 | Monterrosa | |
| 7,500,583 | B1 | 3/2009 | Cox | |
| 7,736,098 | B2 * | 6/2010 | Sykora | 406/197 |
| 7,913,932 | B2 * | 3/2011 | Wu | 239/288.5 |
| 7,988,395 | B2 * | 8/2011 | Steffier | 411/385 |

* cited by examiner

SPRAY CONTAINMENT DEVICE AND METHODS OF USE

RELATED APPLICATION DATA

This application claims the priority benefit of U.S. Provisional Application Ser. No. 61/271,847, filed Jul. 27, 2009, which is hereby incorporated in its entirety herein by reference.

FIELD OF THE INVENTION

The present invention relates to a spray containment device for use with a spray apparatus commonly used by gardeners. The device allows attachment of a threaded adapter and cone system to other manufacturers spray apparatus in a manner that furthers application of chemicals such as herbicides to selected vegetation without exposing neighboring vegetation or the operator to the spray. The threaded adapter system could also be used in other fields where the application of threads to unthreaded pipes, and rods would be of utility.

BACKGROUND OF THE INVENTION

Sprayers are commonly used by gardeners to apply chemicals such as herbicides, pesticides, insecticides and fertilizers to vegetation. Typically, these devices include a tank or can which contains the liquid to be sprayed, a flexible hose, and a tubular wand. Often the liquid is pressurized either manually by a hand pump or by using an air compressor or the like. The tubular wand at the end is connected to a spray nozzle that is often adjustable to control the size of the spray.

It is often desired to apply the chemical only to a select plant or area. Using conventional sprayers, it is often difficult to contain the spray to only a select plant or area, and often neighboring plants are treated with the unwanted chemical. This can result from windy or unfavorable air conditions, or in cases where the spray area is too wide to treat a relatively smaller area. Therefore, even if the operator is extremely careful, harmful chemicals can be applied to plants that neighbor the selected area. A further problem is that in windy or other unfavorable air conditions, the operator of the apparatus may be exposed to harmful chemicals.

It is known in the art that certain devices may be attached to spray wands to help alleviate the problem of unwanted exposure of plants and operators to sprayed chemicals. U.S. Pat. No. 6,679,438 discloses a spray guard that can be attached to the spray wand. While the '438 patent provides a device intended to contain the spray area, it fails to provide an attachment that is sturdy and a containment device that is inflexible. Used in thick vegetation, the '438 device fails to provide a strong sidewall that will not easily bend when it meets resistance from various vegetation. Similarly, the spray guard disclosed in the '438 patent may become easily detached from the spray wand due to its attachment device.

Accordingly, there is a need for a sturdy spray containment device that is not easily or accidentally removed from the spray wand through use, is adaptable to a wide range of spray wands, while being easily attached and intentionally unattached to the spray wand.

In addition, the ability to attach threads to a pipe, rod or similarly shaped piece has utility beyond the specific invention being described, especially when attaching a threaded attachment point to a piece that has pre-existing flares or nuts at each end or in cases where the piece has been installed and a secure attachment point becomes required in the run from one end to the other.

SUMMARY OF THE INVENTION

The embodiments of the invention and the method described herein address the shortcomings of the prior art.

In general terms, the invention may be described as including a spray containment device comprising: (a) a threaded adapter; (b) a conical body having a threaded aperture wherein the threaded aperture is adapted to cooperate with said threaded adapter; and (c) at least one threaded nut adapted to thread onto the threaded adapter above the conical body so as to secure the conical body to the threaded adapter.

In another embodiment of the present invention, the spray containment device is attached to a spray wand of a sprayer device. The spray wand may also have a spray nozzle attached to it. Further, the nozzle may be an adjustable nozzle which may be adjustable from a diffuse fan spray to a more concentrated stream-like spray.

The present invention also includes a spray containment device wherein the threaded adapter is attached about the spray wand. Consequently, the conical body may be attached to the spray wand by threading the aperture of the conical body onto the threaded adapter.

The present invention also provides a spray containment device wherein the spray wand is bent at an angle. Generally, the angle is between 10 and 90 degrees, preferably 45 degrees. The bent spray wand is intended to increase the ease with which the operator may use and position both the spray wand and the containment device. Similarly, the present invention provides a spray containment device additionally comprising an extension tube that may be attached to the spray wand on the end opposite the spray containment device.

FIELD OF INVENTION

In another embodiment of the present invention, the threaded adapter comprises a three part system, the external arc of the two mated adapters being threaded, and the internal arc being smooth and sized to match the object to which the threads are being attached. On the surface where the adapters meet when attached, a pin and a complementary pinhole guide the alignment of the exterior and interior arcs. The threads align so that the conical body may be threaded onto the adapter. The diameter of the threads are such that the nut which attaches them to the spray wand can pass over the nozzle.

The invention further includes a sprayer device comprising (a) a liquid container;
(b) a spray wand adapted to conduct a liquid from the liquid container; (c) a threaded adapter having complementary parts adapted to be placed in a mated position so as to form a matched threading, the threaded adapter attached about the spray wand; (d) a conical body having a threaded aperture wherein the threaded aperture is adapted to cooperate with the threaded adapter; and (e) at least one threaded nut adapted to thread onto the threaded adapter above the conical body so as to secure the conical body to the threaded adapter.

The present invention further provides a method of containing spray comprising the steps: (a) identifying a spray target; (b) isolating the spray target by placing a spray containment device described herein over a spray target or target area, wherein the spray containment device is attached to a spray apparatus; and (c) spraying the spray target. Generally, the spray target will be a weed or other unwanted vegetation that the operator wishes to treat with herbicide. Similarly, the spray target may be a selected plant which the operator wishes to fertilize or otherwise treat with a chemical.

In addition, the invention provides a method of attaching threads to pipes or rods or similarly shaped pieces. The three part system, with two mated external threads that provide an internal opening and a matching nut, can be sized to fit a wide range of applications. The attachment of threads in this manner may provide utility by the addition of threads where there were none or by making the cost of production of a threaded attachment point less expensive due to the inexpensive casting of threads rather than by standard tool requiring methods.

DETAILED DESCRIPTION OF THE PREFERRED EMBODIMENTS

In accordance with the foregoing summary, the following describes a preferred embodiment of the present invention which is considered to be the best mode thereof. With reference to the drawings, the invention will now be described in detail with regard for the best mode and preferred embodiment.

Figure 1:
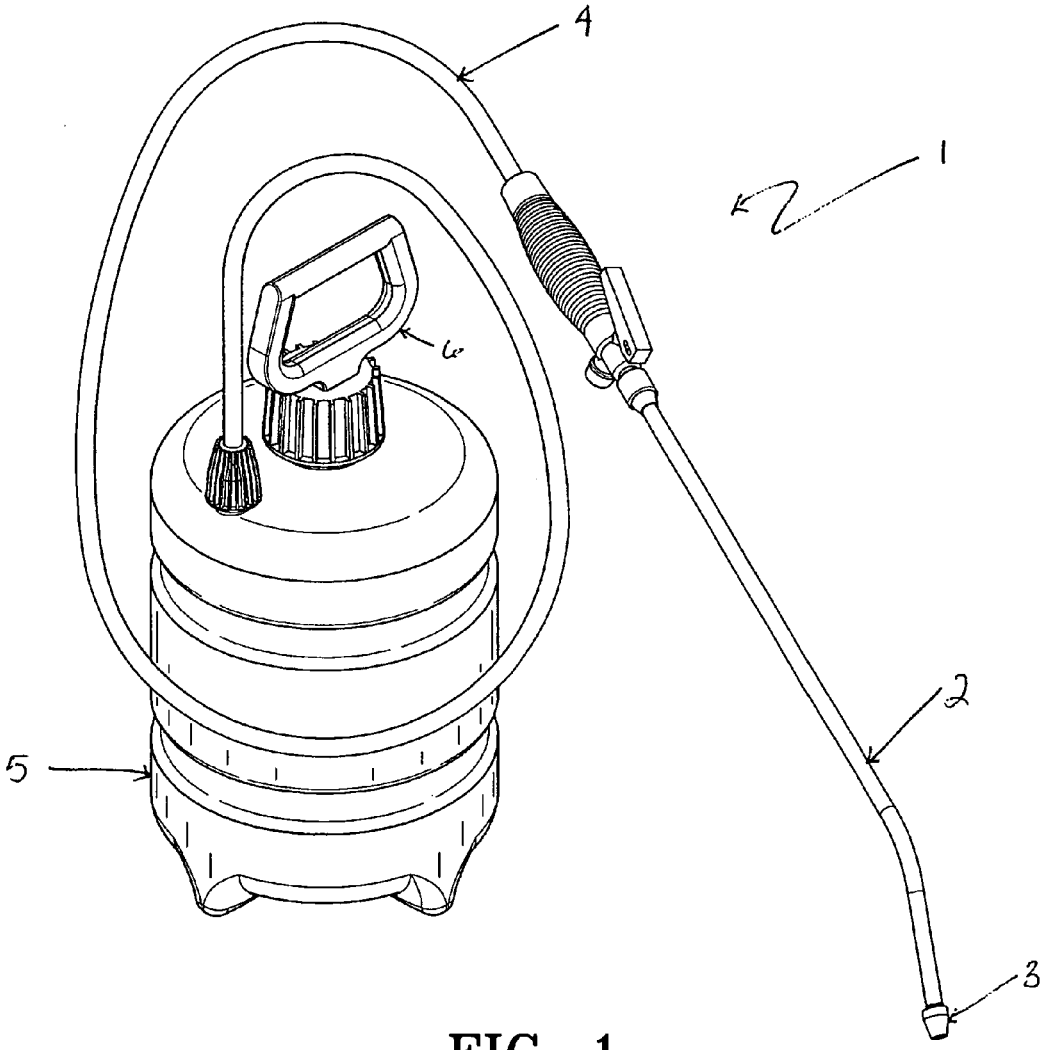
FIG-1 PRIOR ART
FIG. 1 shows a spray apparatus in accordance with the prior art.

FIG. 1 shows a spray apparatus 1 in accordance with the prior art. The spray apparatus has a spray wand 2, a spray nozzle 3, a flexible hose 4, a container 5, and a hand pump 6.

Figure 2:
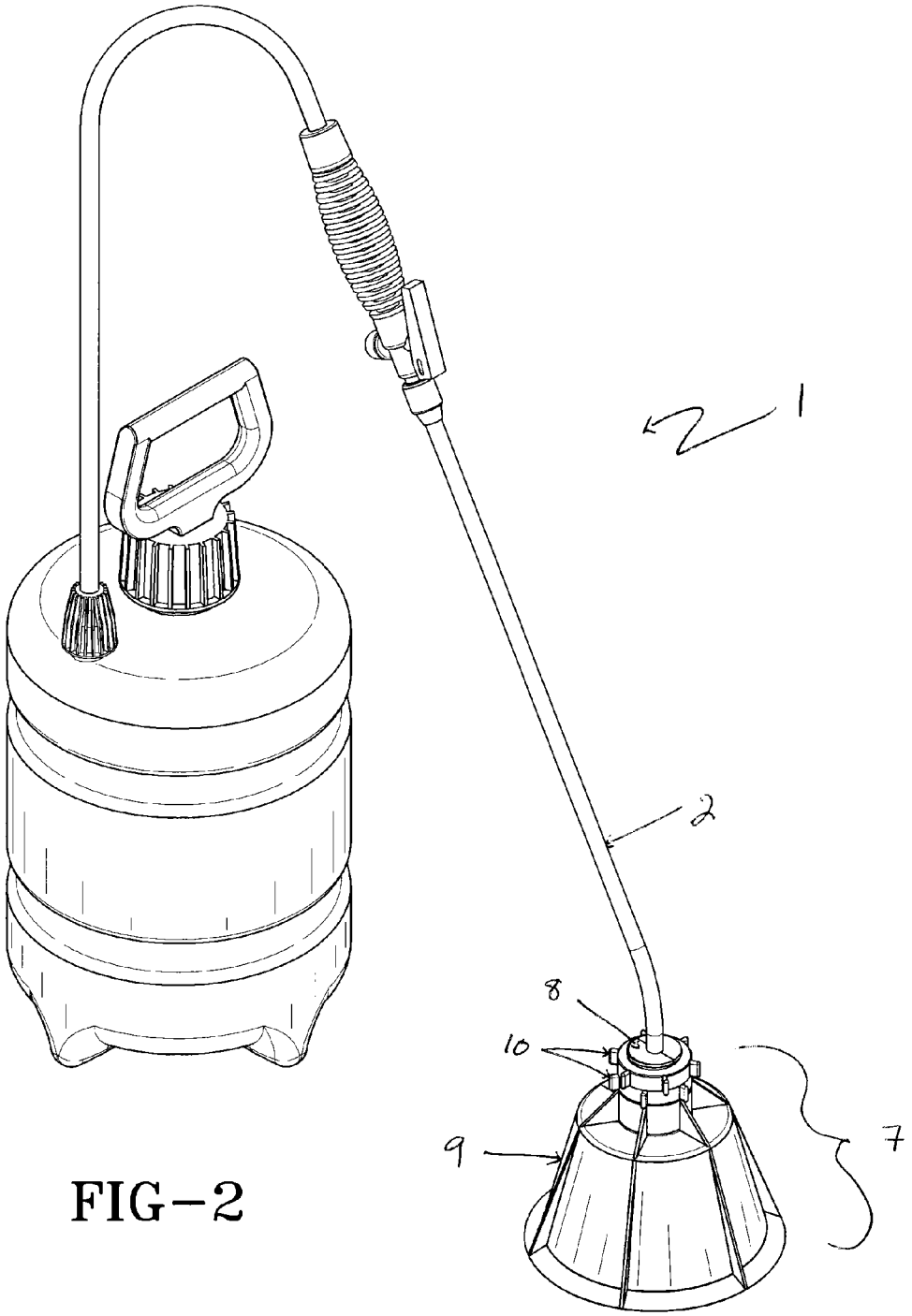
FIG. 2 shows a spray apparatus with a spray containment device, in accordance with one embodiment of the invention.

FIG. 2 shows a spray apparatus 1 with spray wand 2 and containment device 7. FIG. 2 further shows containment device 7 having a threaded adapter 8, conical body 9, and threaded nuts 10.

In the preferred embodiment, the spray wand 2 may be made of any stable material such as a plastic, such as those plastics commonly used in fluid conduits, or lightweight metal. A number of different types of materials may be used for making the extension tube of the present invention. Preferably, the material is plastic that can be molded or machined into the desired shape. The present invention could also be constructed of a lightweight metal that can be cast or machined into the desired shape. In the preferred embodiment, the spray wand has a length of twelve inches with an inside diameter of 3/16 inches, and outside diameter of 5/16 inches.

In the preferred embodiment, the conical body may be made of any stable material such as a plastic or lightweight metal. A number of different types of materials may be used for making the conical body of the present invention. Preferably, the material is plastic that can be molded or machined into the desired shape. The present invention could also be constructed of a lightweight metal that can be cast or machined into the desired shape. Preferably, the conical body is approximately six inches in diameter at the widest end, narrowing to 4 inches in diameter at the narrowest end, with a height of 6 inches in diameter.

Figure 2A:
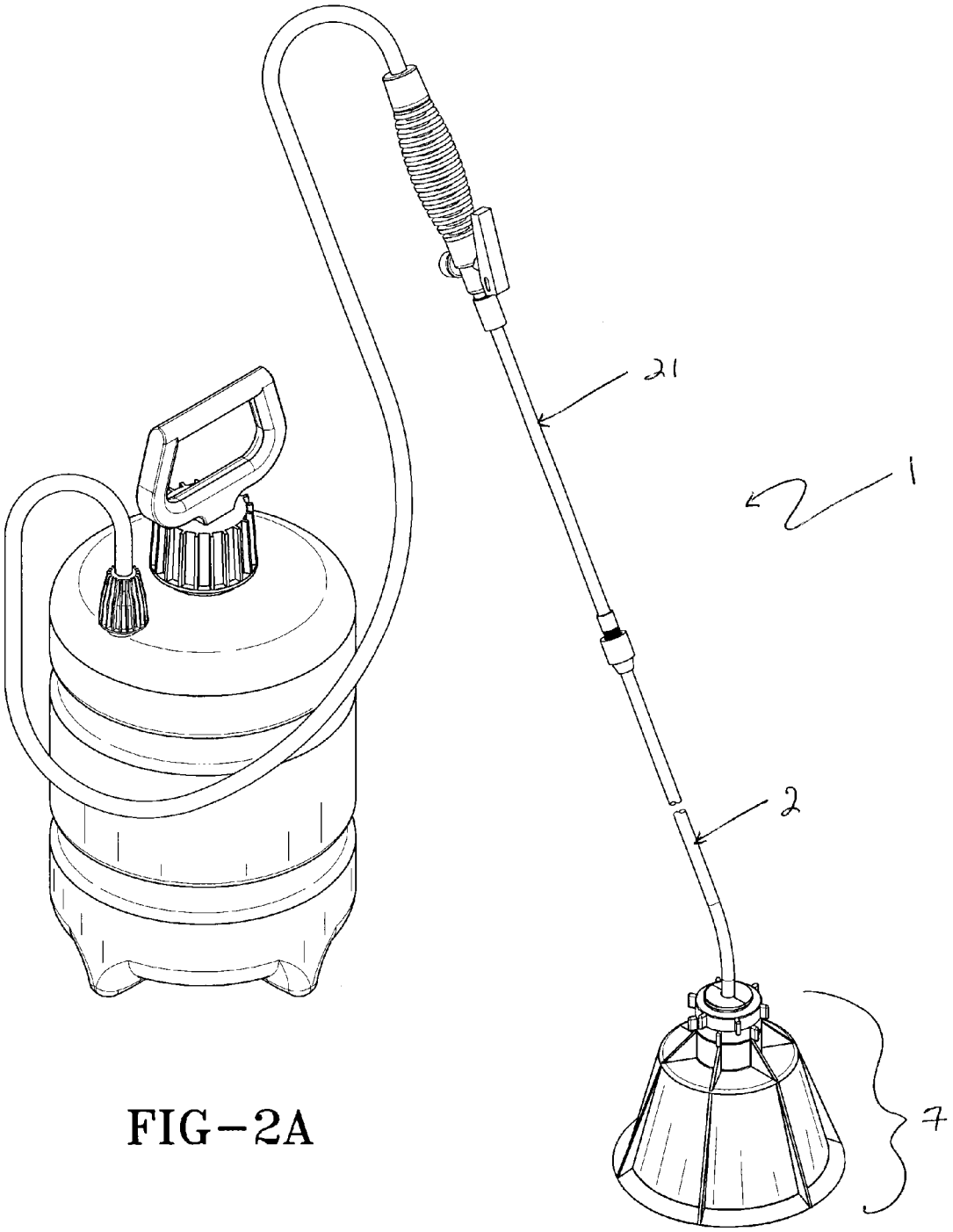
FIG. 2A shows a spray apparatus with an extension tube, in accordance with one embodiment of the invention.

FIG. 2A shows a spray apparatus 1 with spray wand 2, containment device 7 and extension tube 21. The extension tube may similarly be made of any stable material such as a plastic or lightweight metal. A number of different types of materials may be used for making the extension tube of the present invention. Preferably, the material is plastic that can be molded or machined into the desired shape. In the preferred embodiment, the extension tube has a length of twelve inches with an inside diameter of 3/16 inches, and outside diameter of 5/16 inches.

Figure 3:
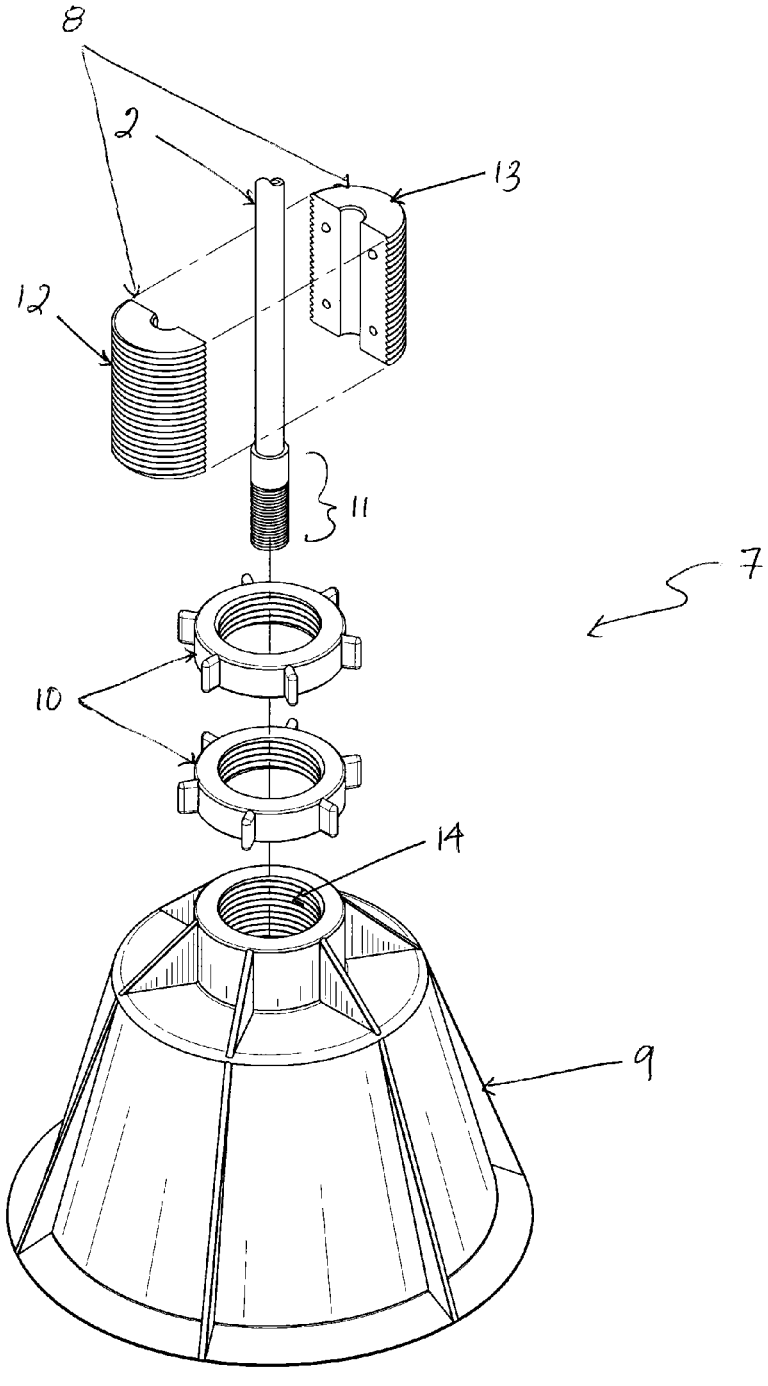
FIG. 3 is an exploded view of a spray containment device and shows the three part thread attachment system, the external arc of the two mated adapters being threaded, and the internal arc being smooth and sized to match the object to which the threads are being attached. On the surface where the adapters meet when attached, a pin and a complementary pinhole guide the alignment of the exterior and interior arcs. This shows how attaching threads to a tube would be utilized in accordance with one embodiment of the invention.

FIG. 3 shows an exploded view of containment device 7 and spray wand 2. In FIG. 3, spray wand 2 has a threaded nozzle section 11. FIG. 3 also shows threaded adapter 8 having adapter parts 12 and 13. Adapter parts 12 and 13 are preferably adapted to attach to one another about spray wand 2, and above threaded nozzle section 11. FIG. 3 shows conical body portion 9 having a threaded aperture 14 and threaded nuts 10.

Figure 4:
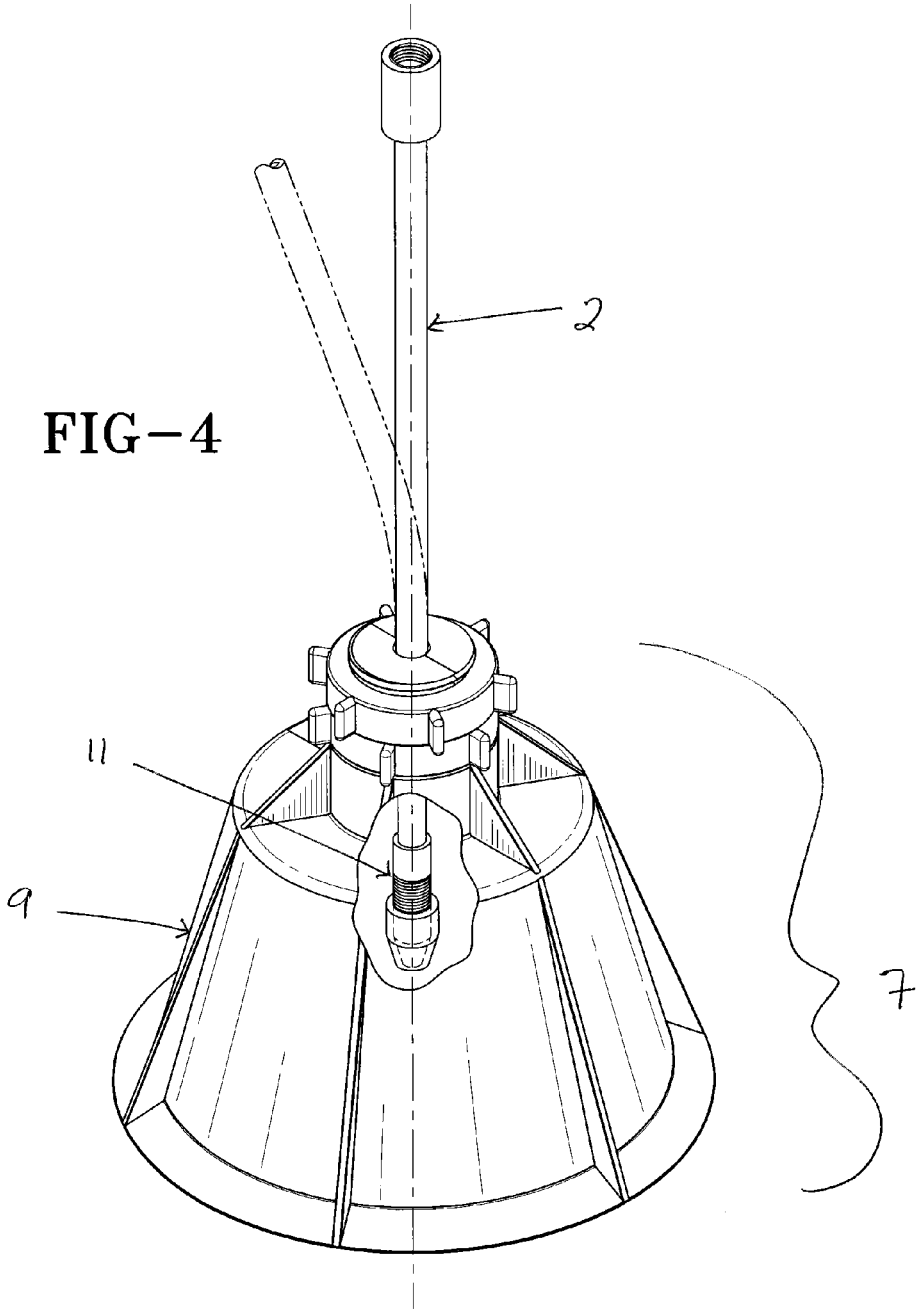
FIG. 4 is a sectioned view of an assembled spray containment device, in accordance with one embodiment of the invention.

FIG. 4 shows the assembled containment device 7 attached to spray wand 2. In the preferred embodiment, the threaded nozzle section 11 of the spray wand 2 extends through threaded aperture 14 (not shown) and into the conical body portion 9. FIG. 4 also shows, in broken lines, a further embodiment of the present invention wherein the spray wand 2 is bent at an angle.

Figure 5:
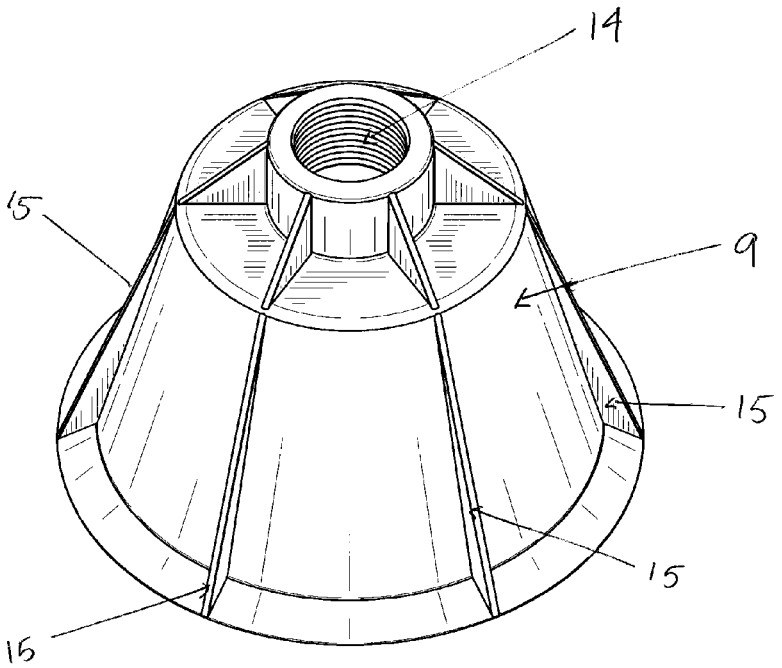
FIG. 5 is a top elevation view of a conical body portion of a spray containment device, in accordance with one embodiment of the invention.
Figure 6:
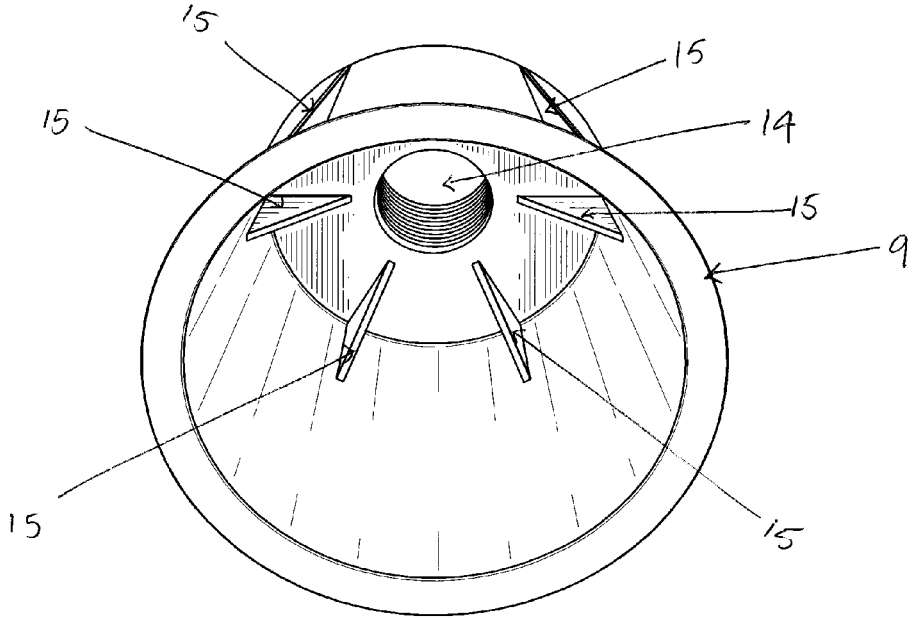
FIG. 6 is a bottom elevation view of a conical body portion of a spray containment device, in accordance with one embodiment of the invention.

FIG. 5 is a top elevation view of conical body portion 9 having threaded aperture 14. FIG. 6 similarly shows a bottom elevation view of conical body portion 9 having threaded aperture 14. FIGS. 5 and 6 further show supporting sidewalls 15 of conical body portion 9.

Figure 7:
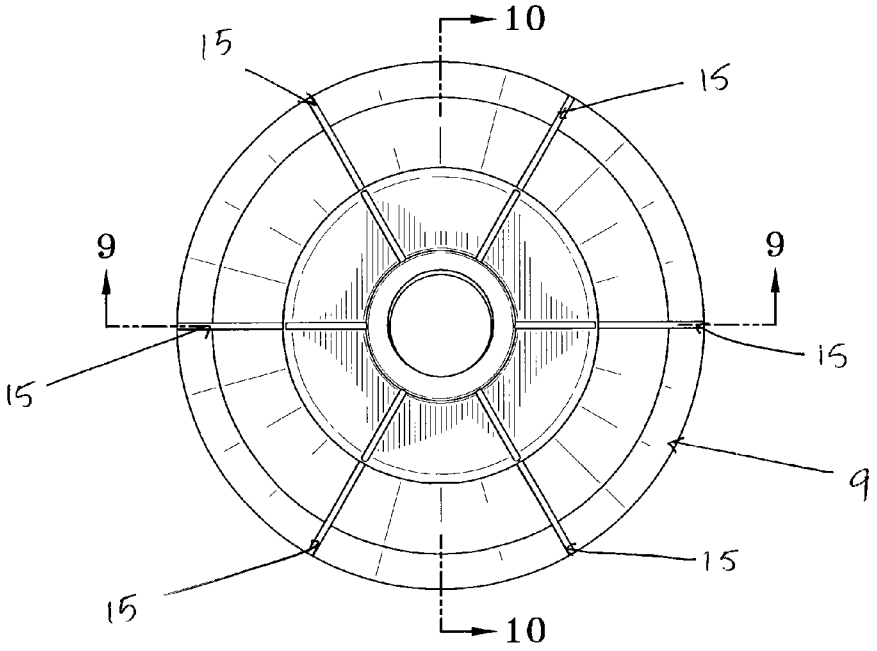
FIG. 7 is a top plan view of a conical body portion of a spray containment device, in accordance with one embodiment of the invention.
Figure 8:
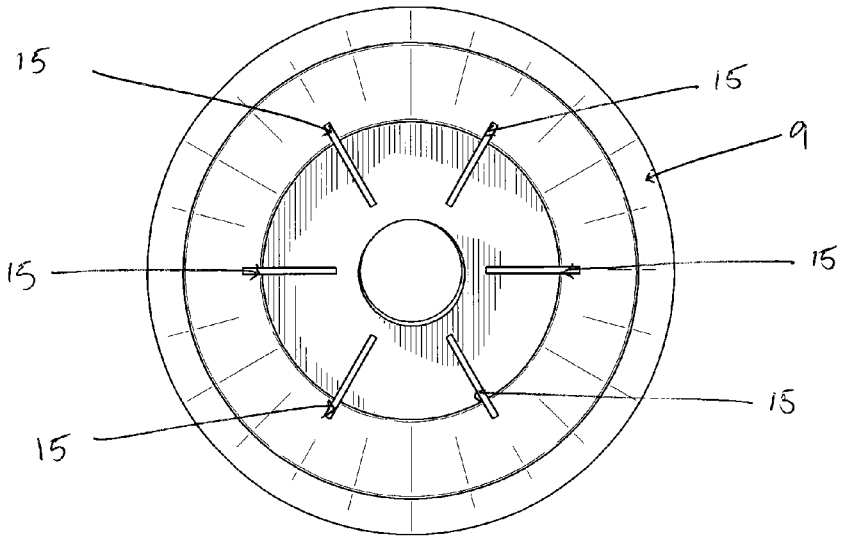
FIG. 8 is a bottom plan view of a conical body portion of a spray containment device, in accordance with one embodiment of the invention.

FIG. 7 shows a top plan view of conical body portion 9. Conversely, FIG. 8 is a bottom plan view of conical body portion 9. Side walls 15 are also shown in FIGS. 7 and 8.

Figure 9:
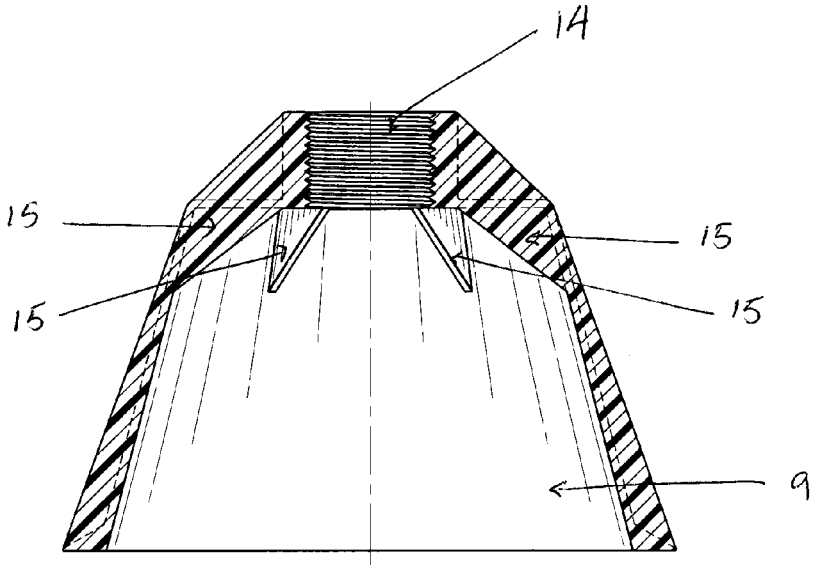
FIG. 9 is a cross section view of a conical body portion of a spray containment device, in accordance with one embodiment of the invention.
Figure 10:
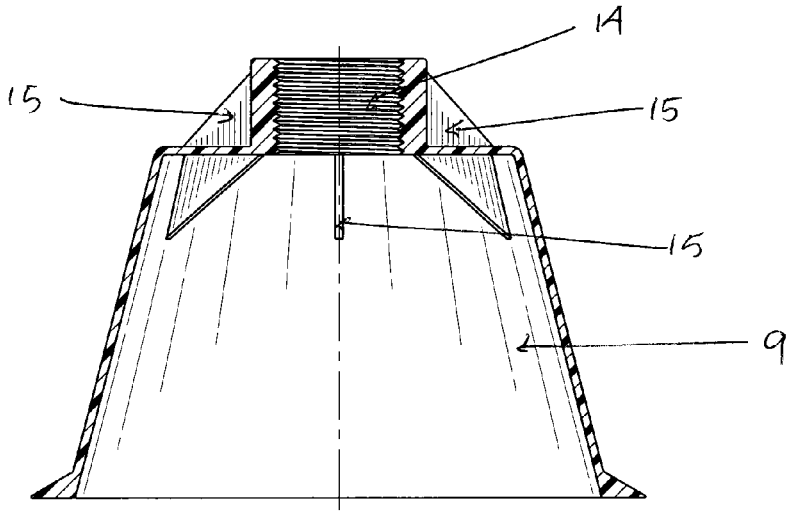
FIG. 10 is a cross section view of a conical body portion of a spray containment device, in accordance with one embodiment of the invention.

FIG. 9 is a cross section view of conical body portion 9, showing side walls 15 and threaded aperture 14. In the preferred embodiment, the entire length of the aperture is threaded, however, it need not necessarily be so in other embodiments.

Figure 11:
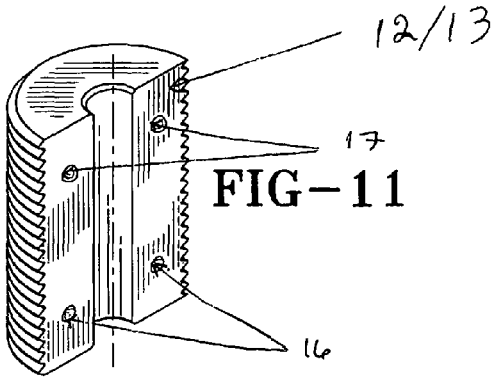
FIG. 11 is a perspective view of a first or second part of a threaded adapter, in accordance with one embodiment of the invention.

FIG. 11 is a perspective view of first or second adapter parts 11 and 12, respectively, of a threaded adapter. FIG. 11 shows adapter part 5, 12 or 13 having complementary dimples 16 and protrusions 17. In the preferred embodiment, adapter parts 12 and 13 will have corresponding dimples and protrusions such that the dimples and protrusions of part 12 cooperate with the dimples and protrusions of 13 when the two pieces are attached to one another, to hold them in position once mated.

Figure 12:
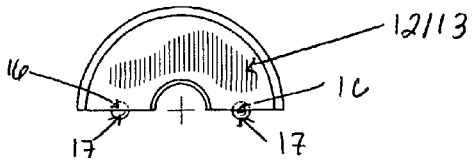
FIG. 12 is a top plan view of a first or second part of a threaded adapter, in accordance with one embodiment of the invention.
Figure 13:
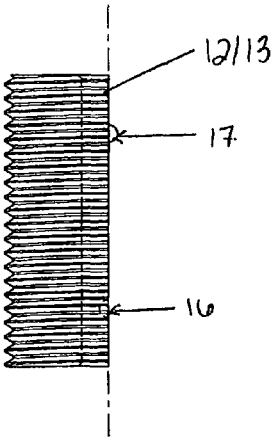
FIG. 13 is a side view of a first or second part of a threaded adapter, in accordance with one embodiment of the present invention.
Figure 14:
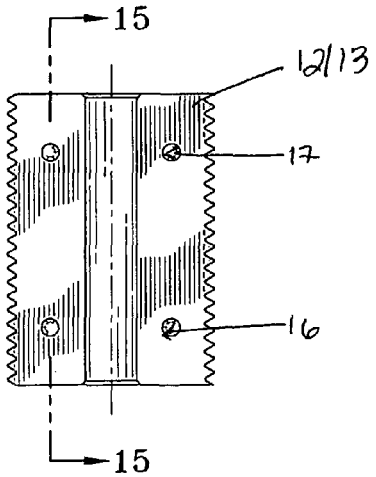
FIG. 14 is a side plan view of a first or second part of a threaded adapter, in accordance with one embodiment of the present invention.
Figure 15:
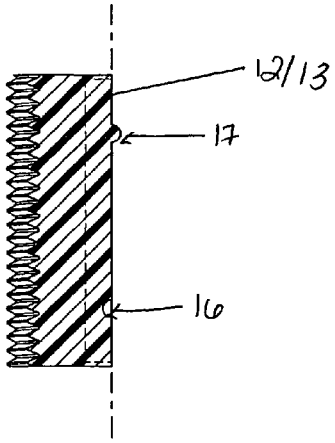
FIG. 15 is a cross section view of a first or second part of a threaded adapter, in accordance with one embodiment of the present invention.

FIG. 12 is a top plan view of adapter parts 12 or 13 of a threaded adapter, showing dimples 16 and protrusions 17, as shown in FIG. 11. Similarly, FIG. 13 is a side view of adapter part 12 or 13 of a threaded adapter, showing dimples 16 and protrusions 17. FIG. 14 is a side plan view of adapter part 12 or 13 of a threaded adapter, showing dimples 16 and protrusions 17, as shown in FIG. 11. Finally, FIG. 15 is a cross section view of adapter part 12 or 13 of a threaded adapter, showing dimples 16 and protrusions 17.

Figure 16:
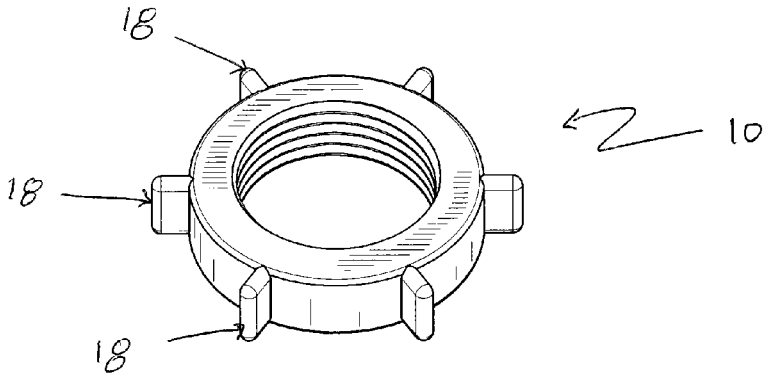
FIG. 16 is a top perspective view of a threaded nut, in accordance with one embodiment of the present invention.
Figure 17:
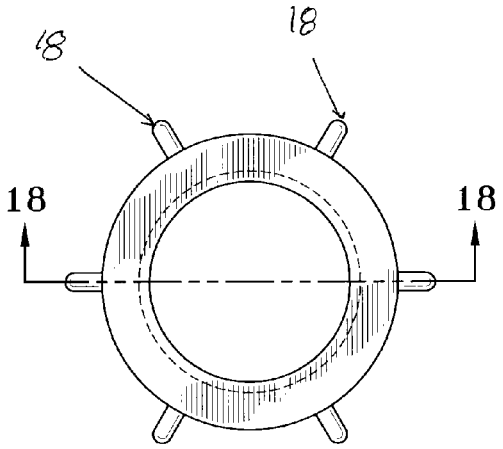
FIG. 17 is a top plan view of a threaded nut, in accordance with one embodiment of the present invention.
Figure 18:
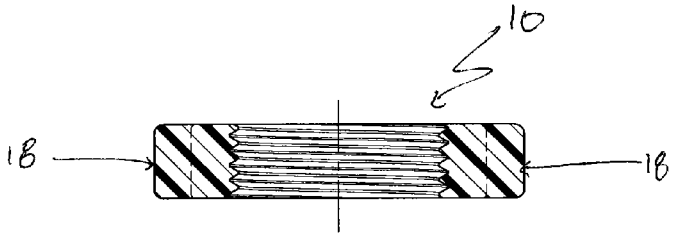
FIG. 18 is a cross section view of a threaded nut, in accordance with one embodiment of the present invention.

FIG. 16 is a top perspective view of a threaded nut 10. In the preferred embodiment, threaded nut 10 has spokes 18 protruding from its outer surface. Spokes 18 may be used to grip the nut as it is threaded onto threaded adapter 14. FIG. 17 is a top plan view of a threaded nut 10, and FIG. 18 is a cross section view of the same threaded nut 10.

Figure 19:
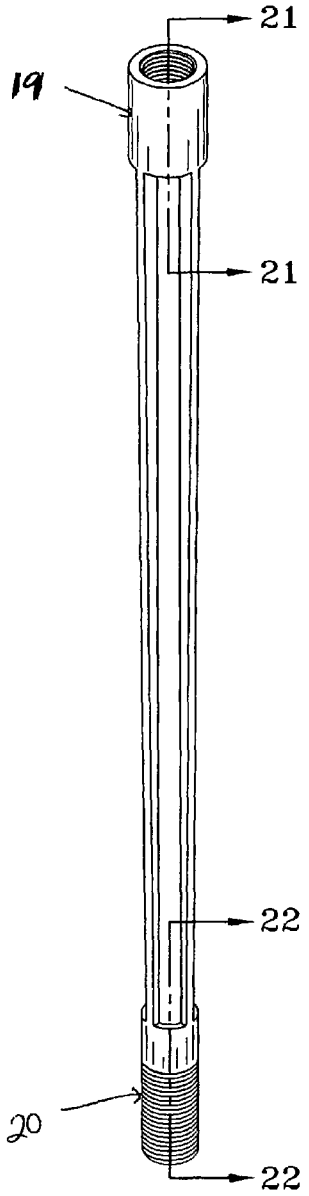
FIG. 19 is a side perspective view of an extension tube, in accordance with one embodiment of the present invention.
Figure 20:
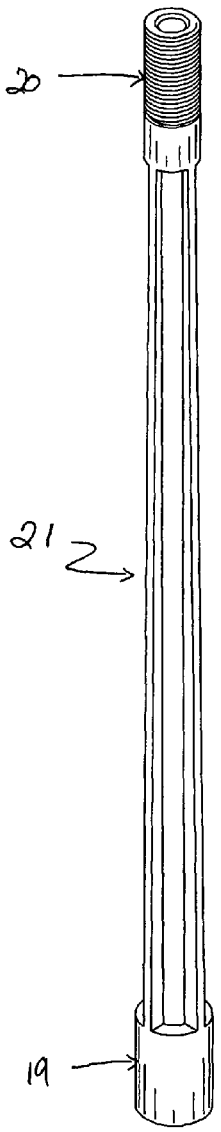
FIG. 20 is a side perspective view of an extension tube, in accordance with one embodiment of the present invention.
Figure 21:
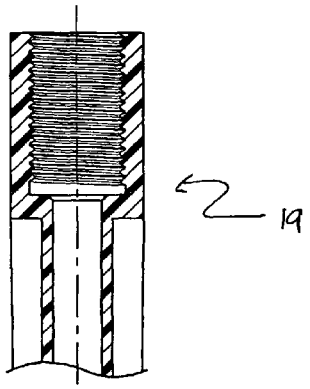
FIG. 21 is a cross section view of one end of an extension tube, in accordance with one embodiment of the present invention.
Figure 22:
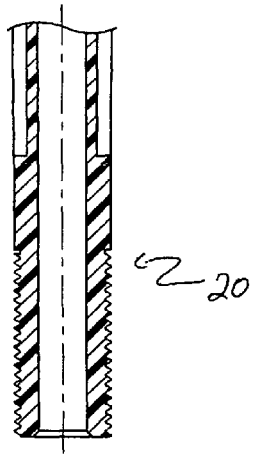
FIG. 22 is a cross section view of one end of an extension tube, in accordance with one embodiment of the present invention.

FIG. 19 shows a side perspective view of an extension tube 21 having terminal end sections 19 and 20. In the preferred embodiment, terminal end section 19 is a female threaded section designed to cooperate with the flexible hose 4 of the spray apparatus. Terminal end section 20 is a male threaded section designed to cooperate with a male threaded end section of a spray wand 2. FIG. 20 also shows a side perspective view of an extension tube 8. FIG. 21 is a cross section view of end 18 of an extension tube 21. FIG. 22 is a cross section view of end 20 of an extension tube 21.

In the preferred embodiment, terminal end 20 has ¼ inch O.D. NSF male threads extending for 1 inch on the extension tube. At the opposite end, terminal end 19 preferably has ¼ inch NSF female threads extending ½ inch into the extension tube.

The preferred embodiment may be used in conjunction with spray apparatuses known in the art and commercially sold. First, the spray wand is removed from a control handle (control handle 22, FIG. 1), and the extension tube is attached to the spray wand and control handle. Second, the threaded adapter parts are placed around the spray wand near the spray nozzle. In some cases, a permanent attachment of the threaded adapter may be accomplished by using an adhesive.

Next, the conical body is threaded onto the threaded adapter. The end of the spray wand should preferably extend approximately one inch into the conical body. Finally, at least one nut is threaded onto the adapter to secure the attachment.

While the invention is susceptible to various modifications and alternative forms, specific embodiments thereof have been shown by way of example in the drawings and are herein described in detail. The extension of the concept of attaching threads to a tube with the system herein described provides a clear understanding that the thread attachment system therein described could be utilized on a different type of pipes, rods or a similarly shaped pieces. It should be understood, however, that the description herein of specific embodiments is not intended to limit the invention to the particular forms disclosed.

What is claimed is:

1. A spray device comprising: a liquid container; a spray wand adapted to conduct a liquid from said liquid container; a threaded adapter comprising a three part system, the three part system including two halves with fully threaded outer convex surfaces forming separable complementary parts, the fully threaded outer convex surfaces form a matched threading when placed in a mated position; the three part system also includes a smooth, internal concave groove extending along the length of both halves of the adapter so as to form a cylindrical pathway when the two halves are mated together, this cylindrical pathway mates around said spray wand of said spray device so as to be in contact with said spray wand of said spray device; the three part system further includes flat surfaces on either side of the smooth, internal concave groove, these flat surfaces also extend along the length of both halves of the adapter, formed in the flat surfaces are complementary dimples and protrusions to hold the two halves in position when they are mated together; further the spray containment device comprises a nut matching the external threads which holds the complementary halves in a mated position around the surface to which the threads are to be attached; a conical body having an internally threaded aperture wherein said threaded aperture is adapted to cooperate with said threaded adapter when the two halves of said threaded adapter are placed in said mated position and about said spray wand so as to be attached thereto; and a second threaded nut adapted to thread onto said threaded adapter above said conical body so as to secure said conical body to said threaded adapter.

2. The spray containment device of claim 1 wherein said spray wand forms an angle.

3. The spray containment device of claim 1 additionally comprising an extension tube, wherein said extension tube is adapted to attach to said sprayer wand.

4. The sprayer containment device of claim 1, wherein said spray wand has a threaded end.

5. The sprayer device of claim 1, wherein said spray wand has a threaded end.

6. The spray device according to claim 1 includes a threaded adapter that can be utilized to attach threads to other types of pipes, rods or similarly shaped pieces.

7. A method of containing spray comprising the steps: identifying a spray target; isolating said spray target by placing a spray containment device comprising a liquid container; a spray wand adapted to conduct a liquid from said liquid container; a threaded adapter comprising a three part system, the three part system including two halves with fully threaded outer convex surfaces forming separable complementary parts, the fully threaded outer convex surfaces form a matched threading when placed in a mated position; the three part system also includes a smooth, internal concave groove extending along the length of both halves of the adapter so as to form a cylindrical pathway when the two halves are mated together, this cylindrical pathway mates around said spray wand of said spray device so as to be in contact with said spray wand of said spray device; the three part system further includes flat surfaces on either side of the smooth, internal concave groove, these flat surfaces also extend along the length of both halves of the adapter, formed in the flat surfaces are complementary dimples and protrusions to hold the two halves in position when they are mated together; further the spray containment device comprises a nut matching the external threads which holds the complementary halves in a mated position around the surface to which the threads are to be attached; a conical body having an internally threaded aperture wherein said threaded aperture is adapted to cooperate with said threaded adapter when the two halves of said threaded adapter are placed in said mated position and about said spray wand so as to be attached thereto; and a second threaded nut adapted to thread onto said threaded adapter above said conical body so as to secure said conical body to said threaded adapter; wherein said spray containment device is attached to a spray apparatus over said spray target and spraying said spray target.

* * * * *